United States Patent [19]

Kessler

[11] 4,015,394

[45] Apr. 5, 1977

[54] DOUBLE-INSULATED GLASS WINDOW WITH INSULATING SPACER

[76] Inventor: Gerald Kessler, 388 Cranberry Road, Broadman, Ohio 44512

[22] Filed: Oct. 14, 1975

[21] Appl. No.: 622,088

[52] U.S. Cl. ..... 52/616; 52/171; 52/399

[51] Int. Cl.[2] ..... E04B 1/62; E04F 15/14

[58] Field of Search ..... 52/398, 399, 403, 616, 52/172, 171, 304; 428/34, 38, 46

[56] References Cited

UNITED STATES PATENTS

| | | | |
|---|---|---|---|
| 2,094,381 | 9/1937 | Slayter | 52/616 |
| 2,285,003 | 6/1942 | Axe | 52/399 |
| 2,340,469 | 2/1944 | Hall | 52/398 X |
| 2,367,035 | 1/1945 | McConnell et al. | 52/398 X |
| 3,442,059 | 5/1969 | Kessler | 52/399 |

*Primary Examiner*—Alfred C. Perham
*Attorney, Agent, or Firm*—Browdy and Neimark

[57] ABSTRACT

A double-insulated glass window consists of at least two panes of glass held apart by plastic spacer members between the rims of the two panes. To prevent contamination of the space between the two panes by volatiles emitted by the plastic, the surface of the plastic spacer member, which is normally exposed to this space, is sealed by applying to it a very thin coating of foil or metal. To further improve the efficiency of the window this metallic surface is sloped at an angle so as to reflect radiant heat back toward the inside surface of the glass in order to help raise the temperature of the inside face of the glass pane.

1 Claim, 4 Drawing Figures

FIG. 1.
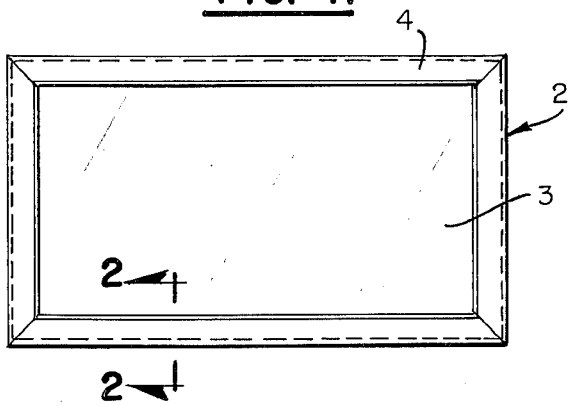
FIG. 2.
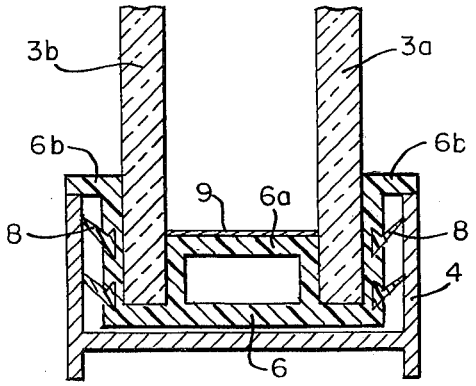
FIG. 3.
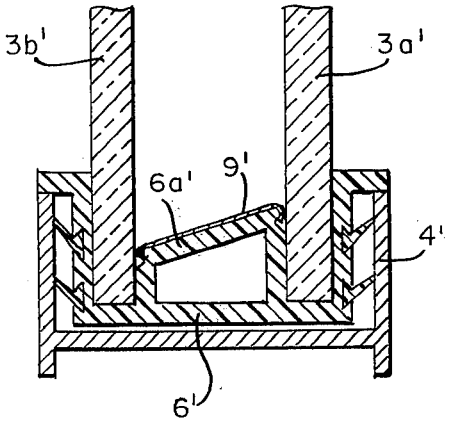
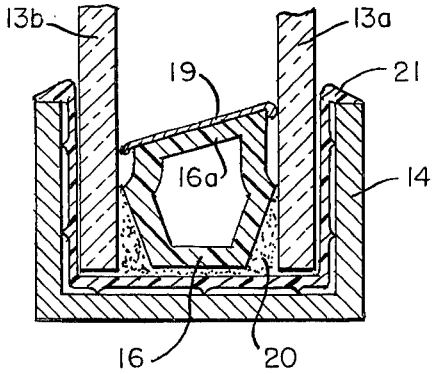
FIG. 4.

DOUBLE-INSULATED GLASS WINDOW WITH INSULATING SPACER

In the present fuel situation, it has become increasingly important to provide proper insulation for buildings. One of the greatest sources of heat loss in a building is the windows, and it has therefore become increasingly important that the windows provide as little heat loss as possible. The glass industry has been using a product known as "double-insulated glass" or D.I.G., also known by the trade name "Thermopane." This product is made by spacing two or more panes of glass apart, using various spacers. About 97% of the spacers are presently made from metal, with the remaining 3% made of the glass itself, e.g., in a product known as "Twindow." Attempts have also been made to use a plastic spacer.

The major problem with metal or glass spacers is the high rate of heat transfer through the metal or glass, which causes a lower inside glass temperature near the edge of the glass due to the greater heat loss in this region. The major problem with plastic spacers is that plastics will eventually give off volatiles and/or combine chemically with the air or pollutants in the air between the glass panes in a non-predicatable fashion. This results in fogging, that is, a buildup on the interior surfaces of the glass where the glass cannot be washed. This type of failure requires that the glass be replaced under the usual warranty, which makes the product much too expensive to be practical. It is a major obect of the present invention to provide a solution to this problem, i.e., to provide a plastic spacer which will not have the above-noted defects. This is accomplished, according to the invention, by coating the exposed interior surface of the plastic surface with an impermeable coating or layer of metal such as chromium, or a vacuum deposit type of coating, which effectively prevents contamination of the air space by preventing contact of this space with the plastic itself. An additional feature tending to improve the thermal efficiency of the window is accomplished by sloping the metallic surface at an angle to reflect heat back toward the inside surface of the glass in order to help raise the temperature on the inside face of the glass.

The specific nature of the invention, as well as other objects and advantages thereof, will clearly appear from a description of a preferred embodiment as shown in the accompanying drawing, in which:

FIG. 1 is a side view of a window according to the invention;

FIG. 2 is a sectional view taken on line 2—2 of FIG. 1;

FIG. 3 is a similar sectional view to FIG. 2, showing an improved form of the invention; and FIG. 4 is a similar sectional view showing the invention applied to a common type of double glass window.

Referring to FIG. 1, the invention is typically embodied in a window 2 having a glass pane 3 and a metal frame or shash 4, commonly of aluminu. As shown in FIG. 2, the glass pane is composed of two parallel sheets 3*a* and 3*b* separated by a plastic spacer 6 having a central spacing ridge 6*a* and side walls 6*b* which are preferably of the type disclosed in FIG. 3 of my U.S. Pat. No. 3,442,059, although any other type of plastic spacer may be employed. The glass panes 3*a* and 3*b* are bonded to the plastic spacer entirely around the periphery of the window so that the interior air space is sealed from contact with the ambient atmosphere.

This interior space is usually clean, dry air, provided by assembling the window in an air-conditioned room, although in some cases dry nitrogen is used in this space. To minimize moisture, a dessicant is also put into this space, preferably attached to the spacer.

The assembled unit consisting of the two glass panes 3a and 3b together with the plastic spacer 6 may be used in any desired type of window, but is commonly set into an extruded aluminum channel 4, as shown in the above patent, where it is retained by means of flexible ribs 8 as fully described in U.S. Pat. No. 3,442,059. The above construction is identical to that described in my prior patent, and has the defect previously noted. This is overcome in the present case by providing an impermeable layer 9 to the surface of the plastic spacer which is exposed to the interior space between the two glass panes. This layer can be applied as a very thin foil of metal, or a plating such as chromium, or a vacuum deposit type of coating. The essential thing is that it be a type which is completely impervious to the passage of volatile gases or elements from the plastic 6. Such volatiles are formed very slowly, and apparently migrate through the plastic. If they cannot pass through the impervious layer 9, they will migrate to the outer atmosphere, through the other surfaces of the plastic spacer.

FIG. 3 shows a construction generally similar to that of FIG. 2, except that in this case the interior surface 6*a*′ of the plastic spacer 6′ is sloped as shown toward the glass pane 3*b*′, which is preferably placed on the warm side of the window, i.e., in the case of a building, on the interior side. Due to this slope, the metallic surface 9′ will tend to reflect heat back toward the inside surface of the glass and thus help rise the temperature of the inside face of the glass, tending to reduce heat transmission through the glass from the interior of the building. In order to facilitate this, the thin foil 9′ is preferably such that it has a high coefficient of reflection, which is easily provided in the case of a metallic layer.

FIG. 4 shows the invention applied to a conventional type of D.I.G. window. In this case the channel 14 holds the two glass panes 13*a* and 13*b* which are separated by plastic spacer 16, similar to a conventional type of plastic spacer, except that the upper surface 16*a* is sloped inwardly, similar to surface 6*a*′ of FIG. 3, and is provided with an impervious coating 19, similar to coating 9′. A conventional glazing channel 21 is also provided and the spacer 16 is preferably imbedded in a conventional sealant 20 such as polysulfide or butyl, as is well-known. The improvement consists in sloping the surface 16a and in providing the impermeable layer 19.

I claim:

1.

a. An insulating window comprising two parallel spaced-apart glass panes separated by an enclosed interior space, b. a plastic space member sealing and separating said glass panes, said space member extending longitudinally along the outer edges of the panes between their inner faces, and having an interior surface which faces the interior space between the two panes and extends laterally between said inner faces of the panes, c. an impermeable, very thin metallic coating on said interior surface of the plastic member extending continuously from one of said panes to the other and thus shielding the interior space between the two panes from direct contact with said interior surface of the plastic member, d. said interior surface of the plastic member extending at an angle to the inner faces of said panes, and the exposed surface of said impermeable coating being highly reflective so that radiant heat striking said surface of said coating will be reflected preferentially toward one of said panes rather than toward the other one, to increase the heating effect on the side toward which the radiant heat is directed.

* * * * *